US009903170B2

(12) United States Patent
Paulsen

(10) Patent No.: US 9,903,170 B2
(45) **Date of Patent: *Feb. 27, 2018**

(54) METHOD EMPLOYING PRESSURE TRANSIENTS IN HYDROCARBON RECOVERY OPERATIONS

(71) Applicant: Impact Technology Systems AS, Oslo (NO)

(72) Inventor: Jim-Viktor Paulsen, Drammen (NO)

(73) Assignee: IMPACT TECHNOLOGY SYSTEMS AS, Oslo (NO)

( * ) Notice: Subject to any disclaimer, the term of this patent is extended or adjusted under 35 U.S.C. 154(b) by 0 days.

This patent is subject to a terminal disclaimer.

(21) Appl. No.: 15/071,856

(22) Filed: Mar. 16, 2016

(65) Prior Publication Data

US 2016/0362955 A1 Dec. 15, 2016

Related U.S. Application Data

(63) Continuation of application No. 13/703,838, filed as application No. PCT/EP2011/059914 on Jun. 15, 2011.

(30) Foreign Application Priority Data

Jun. 17, 2010 (EP) ..... 10166302

(51) Int. Cl.
*E21B 43/25* (2006.01)
*E21B 28/00* (2006.01)
(Continued)

(52) U.S. Cl.
CPC ..... *E21B 28/00* (2013.01); *E21B 43/003* (2013.01); *E21B 43/16* (2013.01); *E21B 43/20* (2013.01)

(58) Field of Classification Search
CPC ..... E21B 443/003; E21B 28/00
See application file for complete search history.

(56) References Cited

U.S. PATENT DOCUMENTS 1,730,336 A 10/1929 Belloco
2,887,956 A 5/1959 Kunkel
(Continued)

FOREIGN PATENT DOCUMENTS

CN 1768202 A 5/2006
CN 1921987 A 2/2007
(Continued)

OTHER PUBLICATIONS

Sing: "Generation of pressure pulses by impacting an opposed-anvil setup with a low velocity projectile", Rev. Sci. Instrum vol. 60 (2), Feb. 1989, pp. 253-257.
(Continued)

*Primary Examiner* — Angela M DiTrani
*Assistant Examiner* — Avi Skaist
(74) *Attorney, Agent, or Firm* — Muncy, Geissler, Olds & Lowe, P.C.

(57) ABSTRACT

Methods to induce pressure transients in fluids for use in hydrocarbon recovery operations. Pressure transients are induced in a fluid by a collision process. The collision process employs a moving object that collides outside the fluid with a body that is in contact with the fluid inside a partly enclosed space. The pressure transients must be allowed to propagate in the fluid. The fluid may be one or more of the following group: primarily water, consolidation fluid, treatment fluid, cleaning fluid, drilling fluid, fracturing fluid and cement.

15 Claims, 9 Drawing Sheets

(51) Int. Cl.

| | |
|---|---|
| ***E21B 43/00*** | (2006.01) |
| ***E21B 43/16*** | (2006.01) |
| *E21B 43/20* | (2006.01) |

(56) References Cited

U.S. PATENT DOCUMENTS

| | | | | |
|---|---|---|---|---|
| 3,048,226 | A | 8/1962 | Smith | |
| 3,189,121 | A | 6/1965 | Vander Stoep | |
| 3,367,443 | A * | 2/1968 | Mayne | G01V 1/147 181/114 |
| 3,586,461 | A | 6/1971 | Erlandson | |
| 3,974,652 | A | 8/1976 | Lovmark | |
| 4,049,053 | A | 9/1977 | Fisher et al. | |
| 4,147,228 | A * | 4/1979 | Bouyoucos | G01V 1/147 181/114 |
| 4,341,505 | A * | 7/1982 | Bentley | E21B 43/003 417/240 |
| 4,429,540 | A | 2/1984 | Burnham | |
| 4,621,656 | A | 11/1986 | Ichimaru | |
| 4,622,473 | A | 11/1986 | Curry | |
| 4,863,220 | A | 9/1989 | Kolle | |
| 4,901,290 | A | 2/1990 | Feld et al. | |
| 4,917,575 | A | 4/1990 | Miller, Jr. et al. | |
| 5,000,516 | A | 3/1991 | Kolle et al. | |
| 5,152,674 | A | 10/1992 | Marx | |
| 5,249,929 | A | 10/1993 | Miller, Jr. et al. | |
| 5,282,508 | A | 2/1994 | Ellingsen et al. | |
| 5,425,265 | A | 6/1995 | Jaisinghani | |
| 5,628,365 | A | 5/1997 | Belonenko | |
| 5,950,726 | A * | 9/1999 | Roberts | E21B 43/003 166/117.6 |
| 5,950,736 | A | 9/1999 | Goldstein | |
| 6,015,010 | A | 1/2000 | Kostrov | |
| 6,020,653 | A | 2/2000 | Woodbridge et al. | |
| 6,237,701 | B1 | 5/2001 | Kolle et al. | |
| 6,241,019 | B1 | 6/2001 | Davidson et al. | |
| 6,729,042 | B2 | 5/2004 | Lee | |
| 6,910,542 | B1 | 6/2005 | Walter | |
| 6,976,507 | B1 | 12/2005 | Webb et al. | |
| 7,245,041 | B1 | 7/2007 | Olson | |
| 7,304,399 | B2 | 12/2007 | Leijon et al. | |
| 7,318,471 | B2 * | 1/2008 | Rodney | E21B 37/08 166/177.2 |
| 7,405,489 | B2 * | 7/2008 | Leijon | F03B 13/189 290/42 |
| 7,464,772 | B2 | 12/2008 | Hall et al. | |
| 7,816,797 | B2 | 10/2010 | Nair | |
| 2001/0017206 | A1 | 8/2001 | Davidson et al. | |
| 2002/0050359 | A1 | 5/2002 | Eddison | |
| 2003/0201101 | A1 | 10/2003 | Kostrov et al. | |
| 2004/0071566 | A1 | 4/2004 | Hill, Jr. | |
| 2004/0256097 | A1 | 12/2004 | Byrd et al. | |
| 2005/0084333 | A1 | 4/2005 | Zadig | |
| 2005/0169776 | A1 | 8/2005 | McNichol | |
| 2005/0189108 | A1 * | 9/2005 | Davidson | B01J 8/16 166/249 |
| 2005/0224229 | A1 * | 10/2005 | Blacklaw | E21B 47/0006 166/253.1 |
| 2005/0236190 | A1 | 10/2005 | Walter | |
| 2006/0293857 | A1 | 12/2006 | Moos et al. | |
| 2007/0187090 | A1 | 8/2007 | Nguyen et al. | |
| 2007/0187112 | A1 | 8/2007 | Eddison et al. | |
| 2007/0251686 | A1 | 11/2007 | Sivrikoz et al. | |
| 2009/0107723 | A1 | 4/2009 | Kusko et al. | |
| 2009/0159282 | A1 | 6/2009 | Webb et al. | |
| 2009/0178801 | A1 | 7/2009 | Nguyen et al. | |
| 2009/0200018 | A1 | 8/2009 | Sivrikoz et al. | |
| 2009/0272555 | A1 | 11/2009 | Wisakanto et al. | |
| 2009/0301721 | A1 | 12/2009 | Barykin | |
| 2009/0308599 | A1 | 12/2009 | Dusterhoft et al. | |
| 2011/0011576 | A1 | 1/2011 | Cavender et al. | |
| 2011/0108271 | A1 | 5/2011 | Hinkel et al. | |
| 2012/0175107 | A1 | 7/2012 | Kostrov et al. | |
| 2013/0233059 | A1 | 9/2013 | McDonnell et al. | |

FOREIGN PATENT DOCUMENTS

| | | | |
|---|---|---|---|
| CN | 101432502 | A | 5/2009 |
| DE | 75164 | | 8/1893 |
| DE | 102005005763 | | 8/2006 |
| EP | 2 063 123 | A2 | 5/2009 |
| EP | 2063123 | A2 | 5/2009 |
| EP | 2063126 | A2 | 5/2009 |
| GB | 2027129 | A | 2/1980 |
| JP | 2001082398 | | 3/2001 |
| NO | 20092071 | | 11/2010 |
| RU | 16527 | U1 | 1/2001 |
| RU | 2171354 | | 7/2001 |
| SU | 1710709 | A1 | 2/1992 |
| WO | WO 2004/085842 | A1 | 10/2004 |
| WO | WO 2004/113672 | A1 | 12/2004 |
| WO | WO 2005/079224 | A2 | 9/2005 |
| WO | WO 2005/093264 | A1 | 10/2005 |
| WO | WO 2006/129050 | A1 | 12/2006 |
| WO | WO 2007/076866 | A1 | 7/2007 |
| WO | WO 2007/100352 | A1 | 9/2007 |
| WO | WO 2007/113477 | A1 | 10/2007 |
| WO | WO 2007/127766 | A1 | 11/2007 |
| WO | WO 2007/139450 | A2 | 12/2007 |
| WO | WO 2008/054256 | A1 | 5/2008 |
| WO | WO 2009/063162 | A2 | 5/2009 |
| WO | WO 2009/082453 | A2 | 7/2009 |
| WO | WO 2009/089622 | A1 | 7/2009 |
| WO | WO 2009/111383 | A2 | 9/2009 |
| WO | WO 2009/132433 | A1 | 11/2009 |
| WO | WO 2009/150402 | A2 | 12/2009 |
| WO | WO 2010/137991 | A | 12/2010 |
| WO | WO 2011/157740 | A1 | 12/2011 |

OTHER PUBLICATIONS

F. Herrmann and M. Seitz: "How does the ball-chain work", Am. J. Phys. vol. 50 (11), Nov. 1982, pp. 023-035.

Pride, et al.: "Seismic stimulation for enhanced oil recovery", Geophysics, vol. 73, Sep. 17, 2008, pp. 023-035.

F. Hermann and P. Schmalsle: "Simple explanation of a well-known collision experiment", Am. J. Phys. vol. 48(8); Aug. 1981, pp. 761-764.

Dusseault et al., Pressure Pulsing: The Ups and Downs of Starting a New Technology, JCPT (200).

Maurice Dusseault, et al., "Pressure Pulsing: The Ups and Downs of Starting a New Technology", JCPT, Apr. 2000, vol. 39, No. 4, pp. 13-19.

F. Hermann and M. Seitz, "How does the ball-chain work?", Am. J. Phys., vol. 50, No. 11, Nov. 1982, pp. 977-981.

* cited by examiner

| Experiments<br>A=Standard method<br>*B =Pressure Transients* | Core Pore Volume (ml) | Dimension L/D (cm) | Kw (mDarcy) | Original oil in Place (ml) | Flooding speed (μm/s) | Oil Produced (ml) | Oil Recovery (% of OOIP) |
|---|---|---|---|---|---|---|---|
| 1 A | 37.0 | 14.8/3.79 | 540 | 30.0 | 1.48 | 16.1 | 53.6 |
| ***1 B*** | ***37.3*** | ***14.8/3.79*** | ***540*** | ***29.9*** | ***1.48*** | ***19.4*** | ***64.9*** |
| 2 A | 19.7 | 10.0/3.705 | 134 | 15.8 | 1.55 | 8.3 | 52.5 |
| ***2 B*** | ***19.7*** | ***10.0/3.705*** | ***134*** | ***16.1*** | ***1.55*** | ***9.3*** | ***57.8*** |
| 3 A | 37.0 | 14.8/3.79 | 540 | 30.0 | 14.8 | 16.2 | 54.0 |
| ***3 B*** | ***37.0*** | ***14.8/3.79*** | ***540*** | ***30.6*** | ***30-40*** | ***20.7*** | ***67.6*** |
| 4 A | 19.7 | 10.0/3.705 | 134 | 15.8 | 15.5 | 8.4 | 53.2 |
| ***4 B*** | ***19.7*** | ***10.0/3.705*** | ***134*** | ***16.1*** | ***15.5*** | ***9.9*** | ***61.5*** |

Fig. 7

METHOD EMPLOYING PRESSURE TRANSIENTS IN HYDROCARBON RECOVERY OPERATIONS

CROSS-REFERENCE TO RELATED APPLICATIONS

This application is a Continuation of co-pending application Ser. No. 13/703,838, filed on Dec. 12, 2012, which is a U.S. National Stage of International Application PCT/EP11/59914 filed on Jun. 15, 2011, for which priority is claimed under 35 U.S.C. § 120; and this application claims priority of Application No. 10166302.9 filed in Europe on Jun. 17, 2010 under 35 U.S.C. § 119, the entire contents of all of which are hereby incorporated by reference.

FIELD OF THE INVENTION

This invention relates to hydrocarbon recovery operations and to a method for increasing the efficiency of these operations aiming at increasing the hydrocarbon recovery factor from subterranean reservoir formations and increasing the penetration through porous media.

BACKGROUND

Hydrocarbon recovery operations may in general involve a broad range of processes involving the use and control of fluid flow operations for the recovery of hydrocarbon from subterranean formations, including for instance the inserting or injection of fluids into subterranean formations such as treatment fluids, consolidation fluids, or hydraulic fracturing fluids, water flooding operations, drilling operations, cleaning operations of flow lines and well bores, and cementing operations in well bores.

Employing pressure pulse technology (PPT) in hydrocarbon recovery operations has gained significant interest during the last few years and there are many patent application and patents where PPT is included.

Hydrocarbon recovery operations may for instance require tools for cleaning of casing, deposits from near well bore areas, perforations and screens. In wells with increased water production (waterflood projects) and geothermal wells, scale and deposit buildups are often a major cause of decreased production. Conventional methods of removing such buildups such as acid wash, wire line broaching and even replacing the production string and flow lines are often either expensive or provide only limited success. A further method to clean fluid flow channels or well bores involve the application of pulsating fluid flow as disclosed in e.g. WO2009/063162 and WO2005/093264 where the use of a pulsating fluid flow for the cleaning of surfaces is described as advantageous in comparison to steady fluid flow.

Another hydrocarbon recovery operation where the application of pressure pulses has been described comprises the chemical insertion into a well bore matrix or insertion of treatment fluids into a subterranean formation. The effectiveness of such methods depend among other things on the ability of the insertion fluid to penetrate the formation which often comprises shales, clays, and/or coal beds of generally a low permeability.

Further, wells are often located in unconsolidated portions of a subterranean formation that contain particles capable of migrating with the flow of a mixture of hydrocarbons and fluids out of a formation and into a well bore. The presence of these particles, such as sand, is undesirable since they may destroy pumps and other producing equipment. One conventional method is to apply a resin composition to the unconsolidated area and then to after-flush the area with a fluid to remove excess resin from the pore spaces of the zones. Such resin consolidation methods are widely used but are limited by the ability of the consolidation fluid (often a resin composition) to achieve a significant penetration or uniform penetration into the unconsolidated portions of a subterranean formation. Methods for injecting a consolidation fluid into a wellbore, as disclosed in US2009/0178801, describes the use of pressure pulsing to enhance the ability of a consolidation fluid to penetrate a portion of a subterranean formation.

In cementing operations in well bores, cement is typically pumped into an annulus between the wall of a well bore and the casing disposed therein. The cement cures in the annulus and thus forms a hardened sheath of cement that supports the pipe string in the well bore. Influx of fluid and gas during the cement curing is common, and this can damage the cement bond between the well bore formation and the exterior surface of the casing. Methods for reducing fluid or gas migration into the cement are disclosed in e.g. US2009/0159282, comprising the step of inducing pressure pulses in the cement before the cement has cured.

The injection of hydraulic fracturing fluids into subterranean reservoir formations makes it possible to produce hydrocarbons where conventional technologies are ineffective, and the method applies fluid pressure to create fracture in the subterranean reservoir formation allowing hydrocarbons to escape and flow out of a well. Today, through the use of hydraulic fracturing, large amount of deep shale natural gas from across the United States are being produced. Applying pressure pulses during the hydraulic fracturing process has been suggested in order to increase the production of shale natural gas.

Pressure pulse technology may likewise be applied to water flooding operations, where a fluid is continually injected into a subterranean formation while pressure pulses are employed to the fluid as it is being injected.

In general, pressure pulses have been reported to allegedly yields enhancement of flow rates through porous media. However, at present, the literature in the field seem undetermined on the advantages on pulsed injections, as some experiments report on the ability of PPT to increase the recovery factor of hydrocarbons from laboratory core plugs, while some literature report on a lower recovery rate compared to static water flooding. Notice that an increased recovery factor could have many causes, so that a possible effect of pressure pulses alone may be difficult to isolate since the pulsating flow could also contribute.

The enhanced flow rates in porous media allegedly obtained by means of dynamic excitation through applications of pressure pulses has by some been claimed to occur due to the pressure pulses suppressing any tendency for blockage thereby maintaining the reservoir in a superior flowing condition. Also, secondary recovery operations involving replacing a fluid (hydrocarbons) in a porous media (the subterranean reservoir formation) with a second fluid (normally water) is claimed to be enhanced by pressure pulses.

Documents disclosing apparatus for the generation of pressure pulses (sometimes referred to as fluidic oscillators) include e.g. WO2004/113672, WO2005/093264, WO2006/129050, WO2007/100352, WO2009/089622, WO2009/132433, U.S. Pat. No. 6,976,507, and US2009/0107723. Pressure pulses may for instance be generated through a mechanism of convective combustion as described in WO2007/139450, or by igniting a plurality of individual lengths of energetic material as outlined in WO2009/111383 and US2009/0301721.

As mentioned, the application of pressure pulses has been suggested in all the hydrocarbon recovery operations listed above. Further, pressure pulses has likewise been suggested to be used in drilling operations, another hydrocarbon recovery operation. It has also been suggested to apply pressure transients in order to increase the force by which the drill bit is pushed through the subterranean formation as an alternative to using static pressure and drill string weight alone. The pressure transients applied during the drilling operation are conventionally generated by opening and closing valves. Therefore, the flow of drill mud to the drill bit is discontinuous since the flow is interrupted by the closing of the valves.

The amount of hydrocarbon that is recoverable from subterranean reservoirs depends on a number of factors such as the viscosity of the oil, the permeability of the reservoir, and factors like any gas present, pressure from surroundings like adjacent water etc. In general, oil recovery rates employing fluid injection may typically lie in the order of 30-55%, and bearing in mind the impressive potential extra profit obtainable from even very small increases in the oil recovery rate, the presently applied methods in hydrocarbon operations leave ample room for improvements.

As noted above, the use of pressure pulse technology in hydrocarbon recovery operations has gained increasing interest in recent years. More generally, pressure may be formed and applied in different ways, which in view of the proposed methods according to the present invention and the terms used herein, is explained in more detail in the following.

On a microscopic level pressure is the results of the thermal motion of the particles in the fluid, and one can interpret pressure as energy density in the fluid. However, on a macroscopic level pressure is more commonly regarded as the ability of the fluid to exert a force on a body. The force F that the pressure inside a hydraulic cylinder can exert on a piston is given by $F=Ap$, in which A is the size of the surface of the piston which is in contact with fluid inside the hydraulic cylinder. Hence, a standard method of producing a pressure p inside a hydraulic cylinder is to apply a force F on the piston, thereby obtaining a pressure given by $p=F/A$. In this way a static pressure can be generated by a constant force.

A pressure wave is an oscillation of the pressure amplitude in time and space with a given maximum amplitude and frequency. A standing pressure wave has only a variation in time with a frequency equal to the resonant frequency of the system. The standard method of obtaining such pressure waves are by employing an oscillating piston in the fluid, which is thus moved with a given frequency and amplitude.

Pressure pulses can be generated with a piston moved sufficiently fast, but in this case there is not necessarily a given frequency for the motion of the piston. Such an impulse piston could be constructed by use of materials that change their shape in the presence of magnetic fields as explained in US2009/0272555. Typically, the piston is moved fast forward producing the pressure pulse, with a subsequent relatively slow movement backwards. The motion of the piston need not be periodic, and the word frequency does not really have any meaning when describing a pressure pulse. However, the term "frequency" may often be applied in order to specify the time interval between each pressure pulse if generated at regular intervals. An example of such pressure pulse generation is disclosed in WO2004/113672 where a piston is forced up and down within a cylinder by a power pack assembly. The use of such impulse piston however yields a significant increase in the flow rate during the fast movement of the piston and thus during the generation of the pressure pulse.

Pressure pulses may similarly be produced by employing a pressure chamber, where the pressure pulse may be generated in a fluid outside of a pressurized chamber when a valve at the outlet of this chamber is opened rapidly. The outlet valve is then closed and the chamber is filled and pressurized once more by a pump pushing fluid into the chamber through the chamber inlet. The cycle is then repeated in order to generate pressure pulses with a fixed or arbitrary time interval. The term "pressure pulse" originates from this method since a pump and a pressure chamber is needed, which can be associated with the human heart where one chamber then functions as a pump and the other as a pressure chamber.

Applying this last procedure for generating pressure pulses also results in a discontinuous fluid flow since the closing of the valve interrupts the fluid flow.

In general a pressure pulse can be said to have many of the properties of a pressure wave, such as moving with the speed of sound throughout the fluid, and being reflected and transmitted much like a wave. The main difference between pressure pulses and pressure waves is, that pressure pulses in general have a shorter rise time and slow decay rate, i.e. they do not possess the typical periodic sinusoidal shape which is characteristic for pressure waves. Pressure pulses propagate like relatively steep fronts throughout the fluid in comparison to pressure waves moving with a sinusoidal profile. Supposedly the steep front or the relatively short rise time makes the pressure pulses advantageous for applications in hydrocarbon recovery operations.

Understanding the term pressure transients as applied herein and the procedure for generating said pressure transients is important in order to understand the underlying concept of the method described in this disclosure.

An important difference between pressure pulses and pressure transients is related to the two most fundamental laws in nature; conservation of energy and momentum. One may say that pressure pulses do not contain momentum, whereas pressure transients do contain momentum. In fact, momentum is converted into pressure transients during a collision process as will be explained in more details in the following.

There are many methods that can be applied in order to produce a pressure pulse, but to our knowledge there is only one procedure for generating a pressure transient, namely by performing a collision process. Pressure transients in fluids occur in two different types of collisions; 1) when a solid object in motion collides with the fluid, or 2) when a flowing fluid collides with a solid. In the first case, momentum of the solid object is converted into pressure transients in the fluid via the collision process. The last case describes the Water Hammer phenomenon where momentum of the flowing fluid is converted into pressure transients in the fluid. In both cases pressure transients are produced in the fluid.

In a collision process the immense impacting force on the body and resulting loads on the fluid are of large magnitude and short duration so that the dominant terms in describing the motion of the fluid reduce to conservation of momentum. Further, the time scales are so short that the convective terms in the fluids acceleration are negligible. The collision process therefore result in a travelling pressure transient of very high amplitude of a very small duration and of a very steep front compared to conventional pressure pulses.

The conversion of momentum into pressure transients can be explained in more detail by analysing the Water Hammer phenomena where a fluid flowing in a pipeline (with cross section $\sigma$) is forced to stop during a time interval $\Delta t$ due to a sudden closure of a valve. To solve this problem one can follow the work by N. Joukowsky. Newton's second law can be written in the momentum form $F\Delta t=\Delta(mu)$, where F is the force, $\Delta t$ is a time interval and $\Delta(mu)$ is the change in momentum of a body with mass m and velocity u. By applying that a pressure transient can be expressed as $\Gamma=F/\sigma$ one thus obtains $\Gamma\sigma\Delta t=\rho uV=\rho u\sigma L=\rho u\sigma c\Delta t$, where $\sigma$ is the cross section of the pipeline, $\Delta t$ is the time interval of the momentum change $\Delta(mu)$, $V=\sigma L$ is the volume V of the part of the fluid (with density $\rho$) that has lost its momentum, and L is the length that the pressure transient $\Gamma$ has propagated with the sound speed c during the time interval $\Delta t$. The well-known Joukowsky equation $\Gamma=\rho cu$ is thus obtained.

Joukowsky by the work outlined above, has demonstrated that momentum of a flowing fluid can be lost if said momentum is converted into pressure transients in the fluid. Hence, Joukowsky has explained the paradox that momentum of a flowing fluid has been lost during the Water Hammer phenomena. The paradox is related to the fact that momentum must always be conserved, but Joukowsky solved this paradox by showing that pressure transients are produced. Hence, momentum is conserved only if said pressure transients contain said momentum.

This applies also for a moving solid object and not only for a flowing fluid. Notice also that the reversed phenomenon is also true. Pressure transients can only disappear if converted into momentum of a moving solid object or a flowing fluid. Momentum is commonly acknowledged as an important physical property which is usually assumed to only be present in moving solids or flowing fluids. However, Joukowsky has demonstrated that momentum is also contained in pressure transients, but in this case said momentum is not a fluid motion or a motion of a solid object. Pressure transients do not represent any material (atoms or molecules) motion, nevertheless they contain momentum.

This property of the pressure transients induced by a collision process may be advantageous when it comes to mobilizing hydrocarbons that normally are immobile when other prior art methods are applied. This property is something that pressure pulses are lacking. Pressure pulses do not contain momentum, which is in contrast to pressure transients that are compelled to conserve the momentum of the object employed in the collision process that created said pressure transients. This property further makes it possible to claim that pressure transients behave as particles.

In summary, pressure transients can be produced by use of a piston, where a moving solid object collides with the piston (body). Hence, pressure transients can also appear in a fluid if a solid object collides indirectly through another body (such as a piston) with a fluid.

Pressure transients (also often referred to as pressure surge or hydraulic shock) have primarily been reported on and analysed in relation to their potentially damaging or even catastrophic effects when unintentionally occurring for instance in pipe systems or in relation to dams or off-shore constructions due to the sea-water slamming or wave breaking on platforms. Water Hammering may often occur when the fluid in motion is forced to stop or suddenly change direction for instance caused by a sudden closure of a valve in a pipe system. In pipe systems Water Hammering may result in problems from noise and vibration to breakage and pipe collapse. In order to avoid Water Hammering pipe systems are most often equipped with accumulators, bypasses, shock absorbers or the like. One reason for the damaging effects caused by the Water Hammer phenomenon is the formation of cavitations in the fluid system. Such cavitations may occur as the pressure transients in a closed system are prevented from being converted back into momentum and instead are converted into cavitations.

As mentioned, pressure transients may be achieved by the so-called Water Hammer effect as e.g. described in WO2009/082453. The methods described therein involve drilling operations where the flow of the drilling fluid is interrupted by a valve, and the repetitively cycle of opening and closing of the valve generates pressure transients that propagate towards the drill bit with the purpose of enhancing the rate of penetration of the drilling operation. The pressure transients are allegedly pushing the drill bit through the subterranean formation with a substantially higher force than would be achieved using pump pressure and drill string weight alone. Further, employing the Water Hammer effect and the thereby generated pressure transients allegedly has a positive effect on rock chip removal and drilling penetration rate. Examples of such devices exploiting the Water Hammer effect may be found in e.g. U.S. Pat. No. 4,901,290, U.S. Pat. No. 6,237,701, U.S. Pat. No. 6,910,542, U.S. Pat. No. 7,464,772, WO2005/079224, and WO2009/082453. Common to these devices is that the pressure transients are created by the rapid closing and opening of valves, which however is disadvantageous in resulting in a discontinuous fluid flow. Further, the size and thereby the propagation of the pressure transients generated by such opening and closing may be difficult to control.

Another apparatus for generating pressure transients is described in WO2010/137991 for the use in transporting and pumping of fluids. This apparatus generates the pressure transients by employing an object with nonzero momentum which is colliding with a body.

As mentioned above pressure pulses propagate like a relatively sharp front throughout the fluid in comparison to a pressure wave. When comparing pressure transients to pressure pulses, one notice that pressure transients have an even sharper front and travels like a shock front in the fluid as is observed during the Water Hammer phenomena. Pressure transients therefore exhibit the same important characteristic as pressure pulses, but they possess considerably more of this vital effect of having a sharp front or a short rise time. The amplitude of the pressure transients which may be obtained, depend on the initial momentum of the colliding objects (i.e. the masses and initial velocities of the objects involved in the collision process) and on the compressibility of the fluid. An example of this is given in the FIG. 6B, where a pressure transient with amplitude of about 170 Bar (about 2500 psi) has a duration of about 5 ms at the point of measure. This gives an extremely short rise time of about 35 000 Bar/sec for the pressure.

In comparison, during the generation of pressure pulses in a fluid where no momentum is converted from any impacting object, a considerable amount of the energy is applied to move the pulse aggregate (such as the strokes of a piston) and thereby pure transport of the fluid. This is not advantageous since the pressure pulsing device is normally intended to be employed together with a fluid injection device which is more efficient when it comes to transporting fluids.

The particle behaviour of pressure transients may be illustrated by observing the Newton cradle (a popular classic desk toy), where the impact of a first ball from the one side sets the outermost last ball at the opposite side in motion with almost no motion of the balls in between. The momentum of the first ball is converted into a pressure transient that travel trough the intermediate balls, and when the pressure transient arrives at the last ball it behaves as a particle setting this ball in motion. In this way, the momentum from the first ball has been converted into a pressure transient that propagates through the balls in the middle and it is finally converted into momentum, and thus motion, of the outermost last ball. This illustrates the temporary nature of pressure transients. Notice also that the pressure transient has also conserved the energy, thus the conservation of both these laws give the peculiar effect that the impact of two balls at the left result in a corresponding motion of two balls at the right and this applies for any number of balls.

One should realize that, contrary to common belief, the conservation laws of energy and momentum alone are not sufficient to explain this behaviour completely, and a further condition must be satisfied by the systems of balls in the Newton cradle. Said system must be capable of a close to dispersion-free energy propagation. Thus, the pressure transients must propagate with almost no energy losses as described in e.g. Am. J. Phys. 49, 761 (1981) and Am. J. Phys. 50, 977 (1982). This effect can be important when employing pressure transients in hydrocarbon recovery operations.

Pressure transients may be seen as an entity in a temporary or transitory state due to the fact that pressure transients are compelled to conserve the momentum of the object employed in the collision process creating the pressure transients. A pressure transient, which propagates in a fluid, is a temporary state which eventually is converted into a motion of the fluid and/or some object in contact with fluid. Ignoring any energy losses during the process, the final motion should ideally yield a total momentum equal to the momentum initially lost by the first object applied in the collision process where the pressure transients were generated.

In comparison, pressure pulses and pressure waves do not possess any temporary nature as described above in relation to pressure transients, in that pressure pulses and waves may dampen out as they propagate in a fluid due to dissipation effect, but they cannot disappear in the same way as pressure transients when eventually converted back into momentum.

DESCRIPTION OF THE INVENTION

Based on the state of the known art, an object of the embodiments of the present invention is to overcome or at least reduce some or all of the above described disadvantages of the known methods for hydrocarbon recovery operations by providing procedures to increase the hydrocarbon recovery factor.

It is a further object of embodiments of the invention to provide a method for hydrocarbon recovery operations which may yield an increased penetration through porous media.

A further object of embodiments of the invention is to provide alternative methods of generating pressure transients applicable within the field of hydrocarbon recovery operations and applicable to fluids in subterranean reservoir formations or wellbores It is yet a further object of embodiments of the invention to provide a method which may be relatively simple and inexpensive to implement on existing hydrocarbon recovery sites, and yet effective.

According to the invention said objective is achieved by a method in hydrocarbon recovery operations comprising the application of at least one fluid. The method comprises inducing pressure transients in the fluid such as to propagate in said fluid. The pressure transients are induced by a collision process generated by at least one moving object caused to collide outside the fluid with at least one body in contact with the fluid inside at least one partly enclosed space. Advantageous embodiments of the invention are stated in the remaining dependent claims.

By the collision process, energy as well as momentum from the object is converted into pressure transients in the fluid. The pressure transients travel and propagate with the speed of sound through the fluid.

The generation of the pressure transients induced by the collision process may be advantageous due to the hereby obtainable very steep or abrupt pressure fronts with high amplitude, extremely short rise time and of very small width or duration as compared to for instance the pressure pulses obtainable with conventional pressure pulsing technology. Further, the pressure transient induced by the collision process may be seen to comprise increased high frequency content compared for instance to the single frequency of a single sinusoidal pressure wave.

This may be advantageous in different hydrocarbon recovery operations such as for instance in water flooding, inserting of a treatment fluid, or in consolidation processes, as the high frequency content may be seen to increase the penetration rate of the fluid into a porous media where materials of different material properties and droplets of different sizes may otherwise limit or reduce the flowthrough. This may further be advantageous in preventing or reducing the risk for any tendency for blockage and in maintaining a reservoir in a superior flowing condition. An increased penetration rate may likewise be advantageous both in relation to operations of injecting consolidation fluids and in the after-flushing in consolidation operations.

Further, the pressure transients induced by the proposed collision process may advantageously be applied to clean fluid flow channels or well bores yielding improved and more effective cleaning of surfaces. The proposed method may for instance be applied on a cleaning fluid where the apparatus for creating the pressure transient can be inserted into a flow line or a well bore.

Further, the pressure transients induced by the proposed collision process may advantageously be applied in cementing operations in well bores. Here, the inducing of pressure transients into the uncured cement may yield a reduced migration and influx of fluid or gas into the cement.

The application of pressure transients according to the above may further be advantageous in relation to the operations of injection of fracturing fluids into subterranean reservoir formations, where the pressure transients may act to enhance the efficiency of creating fractures in the subterranean reservoir formation allowing hydrocarbons to escape and flow out.

The proposed method according to the above may further be advantageous in drilling operations where the pressure transients as induced by the collision process may increase the drilling penetration rate and act to help in pushing the drill bit through the subterranean formation.

In comparison to the known methods of creating pressure transients in drilling operations based on application of the Water Hammer phenomenon by opening and closing of valves, the method according to the present invention is advantageous in that the pressure transients may here be generated in a continuous fluid flow without affecting the flow rate significantly. Further, the pressure transients may be induced by very simple yet efficient means and without any closing and opening of valves and the control equipment for doing so according to prior art.

By the proposed method it may further be obtained that the pressure transients may be induced in the fluid with no or only a small increase in the flow rate of the fluid as a body is not moved and pressed through the fluid as in conventional pressure pulsing. Rather, the impact from the moving object on the body during the collision may be seen to only cause the body to be displaced minimally primarily corresponding to a compression of the fluid beneath the body. The desired fluid flow rate in the hydrocarbon recovery operation may therefore be controlled more precisely by means of e.g. pumping devices employed in the operation and may as an example be held uniform or near uniform at a desired flow regardless of the induction of pressure transients. The method according to the above may hence be advantageous e.g. in fluid injection and flooding operations where a moderate fluid flow rate with minimal fluctuations in said flow rate may be desirable in order to reduce the risk of an early fluid breakthrough in the formation. In relation to flooding operations, experiments have been performed indicating an increased hydrocarbon recovery factor of 5-15% by the application of pressure transients induced by collision process as compared to a constant static pressure driven flow. The increased recovery rate was obtained with an unchanged flow rate.

The fluid may comprise one or more of the following group: primarily water, a consolidation fluid, a treatment fluid, a cleaning fluid, a drilling fluid, a fracturing fluid, or cement.

The pressure transients may be induced such as to propagate fully or partially in the fluid.

As the moving object collides with the body outside the fluid it may be obtained that the majority if not all momentum of the object is converted into pressure transients in said fluid. Otherwise, in the case the collision process was conducted down in the fluid, some of the momentum of the object would be lost in displacing the fluid prior to the collision.

The moving object may collide or impact directly with the body or indirectly through other collisions. The body may comprise various shapes, such as in the shape of a piston with a head lying on top of or fully submerged in the fluid. Further, the body may be placed in a bearing in the partly enclosed space or may be held loosely in place in the enclosed space. The partly enclosed spaced may be shaped as a cylinder with a fluid pathway in the opposite part of the cylinder relative to the body. The enclosed space may be connected to one or more fluid pathways arranged for fluid communication between the fluid in the enclosed space and the place where the fluid in applied in the hydrocarbon recovery operations such as a subterranean formation or a wellbore. Additionally, the partly enclosed space may be arranged such that the fluid is transported through the partly enclosed space.

The collision process may simply be generated by causing one or more objects to fall onto the body from a given height. The size of the induced pressure transients may then be determined by the mass of the falling object, the falling height and the cross sectional area of the body in contact with the fluid. Hereby the amplitude of the induced pressure transients and the time they are induced may be easily controlled. Likewise, the pressure amplitude may be easily adjusted, changed, or customized by adjusting for instance the masses of the object in the collision process, the fall height, the relative velocity of colliding objects, or cross sectional area (e.g. a diameter) of the body in contact with the fluid. These adjustment possibilities may prove especially advantageous in fluid injection and fluid flooding since the difference between normal reservoir pressure and fracture pressure may often be narrow.

Since the collision process may be performed without the need for any direct pneumatic power source, the proposed method may be performed by smaller and more compact equipment. Further, the power requirements of the proposed method are low compared to for instance conventional pressure pulse technology since more energy may be converted into pressure transients in the fluid by the collision process or impact.

The proposed method of applying pressure transients in hydrocarbon recovery operations may advantageously be operated from a platform or a location closer to the surface as pressure transients travel further than conventional pressure pulses. Thus, the apparatus for performing the method need not necessarily be placed submerged in reservoirs or wellbores or down on the seabed. This may lead to less expensive equipment as well as easier and less expensive maintenance especially when considering offshore operations.

Further, as the method according to the invention need not be conducted down the wellbore or close to the subterranean formation, the pressure transient may possibly be induced into multiple wellbores or fluid injection sites simultaneously.

In general, a feature of pressure pulses that makes them suitable for applications in hydrocarbon recovery operations is that they propagate like a steep front throughout the fluid as mentioned above. As pressure transients have an even steeper front or an even shorter rise time and travels like a shock front in the fluid as observed during the Water Hammer phenomena, pressure transients therefore exhibit the same important characteristic as pressure pulses, but to a higher degree. All the advantages with employing pressure pulses in hydrocarbon recovery operations may therefore be obtained to a higher degree with pressure transients.

In addition, pressure transients travelling downwards in the earth gravitational field may be seen to gain momentum similarly to particles. Therefore, in hydrocarbon recovery operations application with pressure transients may advantageously be performed at the surface to obtain the best effect since the pressure transients may gain a significant momentum as they travel downwards from the surface and into subterranean reservoir formation.

According to an embodiment of the invention, the method in hydrocarbon recovery operations comprises inducing pressure transients in at least one fluid by a collision process, where the collision process involves at least one moving object that collides with at least one body which is in contact with the at least one fluid inside at least one partly enclosed space, and where the pressure transients are allowed to propagate in the at least one fluid which is applied in the hydrocarbon recovery operations.

According to an embodiment of the invention the fluid is at rest and originates from one or more reservoirs. Alternatively, the fluid is flowing and originates from at least one reservoir, and the flowing is obtained by a fluid transporting apparatus.

In an embodiment of the method in hydrocarbon recovery operations, the fluid is inserted into and/or is replacing other fluids in a subterranean reservoir formation.

In an embodiment of the method, the fluid is or comprises primarily water which is inserted into a subterranean reservoir formation during water flooding operations.

In an embodiment of the method, the fluid is or comprises a consolidation fluid which is inserted into unconsolidated portions of a subterranean reservoir formation.

In a further embodiment of the method, the fluid is or comprises a treatment fluid which is applied in chemical treatment of a subterranean reservoir formation.

In yet a further embodiment of the method, the fluid is or comprises a cleaning fluid which is applied in cleaning flow channels and well bores.

In an embodiment of the method, the fluid is or comprises a drilling fluid which is applied in drilling operations where the rate of penetration by the drill bit is essential.

In a further embodiment of the method, the fluid is or comprises a fracturing fluid which is applied in order to create fractures in a subterranean reservoir formation during hydraulic fracturing operations.

In an embodiment of the method, the fluid is or comprises cement that has not cured and which is applied during cementing operations in well bores.

According to an embodiment of the invention, the at least one fluid is provided from at least one reservoir in fluid communication with the partly enclosed space. Further, the method may comprise the step of transporting the at least one fluid from the at least one reservoir by means of at least one fluid transporting apparatus. Hereby, the flow rate may be fully controlled by the fluid transporting apparatus and may be regulated or adjusted continuously according the conditions of the subterranean formation or the wellbore to which the method is applied and the fluid conducted.

In an embodiment of the invention, the collision process comprises the object being caused to fall onto the body by means of the gravity force. As mentioned previously may hereby be obtained a collision process causing pressure transients of considerably size by simple means. The induced pressure amplitudes may be determined and controlled as a function of the falling height of the object, the impact velocity of the object, its mass, the mass of the body and its cross sectional area in contact with the fluid. Pressure amplitudes in the range of 50-400 Bar such as in the range of 100-300 Bar such as in the range of 150-200 Bar may advantageously be applied. The aforementioned parameters likewise influence the pressure rise time which may advantageously be in the range of 1,000-200,000 Bar/sec, such as in the range of 10.000-150.000 Bar/sec, such as in the range of 70,000-120,000 Bar/sec. Similarly, the aforementioned parameters influence the width or duration of the pressure transients which may advantageously be in the range of 0.1-1000 ms at the point of measure such as in the range of 0.5-100 ms such as about a few milliseconds like approximately 1-5 ms.

In an embodiment of the invention, the object collides with the body in a further fluid. Hereby it is obtained that the proposed method may be performed for instance down on the seabed, down in a wellbore or inside a subterranean formation. The further fluid may advantageously have a relatively low viscosity to reduce the resistance and loss of momentum on the moving object prior to the collision. According to an embodiment, the object collides with said body in the air.

In a further embodiment of the invention, the method according to any of the above further comprises generating a number of the collision processes at time intervals, which may act to increase the effect of the pressure transients induced in the fluid. The pressure transients may be induced at regular intervals or at uneven intervals. As an example, the pressure transients may be induced more often and with lower time intervals earlier in the hydrocarbon recovery operation and at longer intervals later. The time intervals between the pressure transients may for instance be controlled and adjusted in dependence on measurements (such as pressure measurements) performed on the same time on the subterranean formation.

According to embodiments of the invention, the collision processes are generated at time intervals in the range of 2-20 sec such as in the range of 4-10 sec. The optimal time intervals may depend on factors like the type of formation, the porosity of the formation, the risk of fracturing etc.

In an embodiment, the method comprises the step of generating a first sequence of collision processes with a first setting of pressure amplitude and time between the collisions, followed by a second sequence of collision processes with a different setting of pressure amplitude and time interval between the collisions. For instance bursts of pressure transients may in this way be delivered in periods. This may be advantageous in increasing the effect of the pressure transients. As previously mentioned, the amplitude and time interval of the induced pressure transients may be easily modified and controlled by for instance adjusting the weight of the moving object or by adjusting its falling height.

In an embodiment of the invention the setting of pressure amplitude is changed by changing the mass of the moving object, or changing the velocity of the moving object relative to the velocity of the body. The pressure amplitudes may hereby be changed in a simple yet efficient and controllable manner according to need.

According to a further embodiment of the invention, the body is positioned such as to separate the fluid from a part of the at least partly enclosed space without fluid. This may for instance be obtained by placing the body as a piston in a cylinder and filling the cylinder with the fluid below the piston.

In yet a further embodiment of the invention, the partly enclosed space comprises a first and a second part separated by the body, and the method further comprises filling the first part with fluid prior to the collision process In an embodiment of the invention, the at least one moving object is connected to at least one wave motion capturing system. Further, the at least one wave motion capturing system may comprise at least one floating buoy arranged such as to be set in motion by waves, and the motion of the at least one floating buoy induces movement of the object, thereby obtaining a nonzero momentum of the object prior to the collision with the body. Hereby it is obtained that the proposed methods for hydrocarbon recovery operations may be powered efficiently and inexpensively yet continuously by the power of waves.

BRIEF DESCRIPTION OF THE DRAWINGS

In the following different embodiments of the invention will be described with reference to the drawings, wherein:

FIG. 7 is a summary of some of the results obtained in water flooding experiments with and without pressure transients.

DETAILED DESCRIPTION OF POSSIBLE EMBODIMENTS

The invention of the present patent application is based on employing pressure transients induced by a collision process in hydrocarbon recovery operation.

Figure 1:
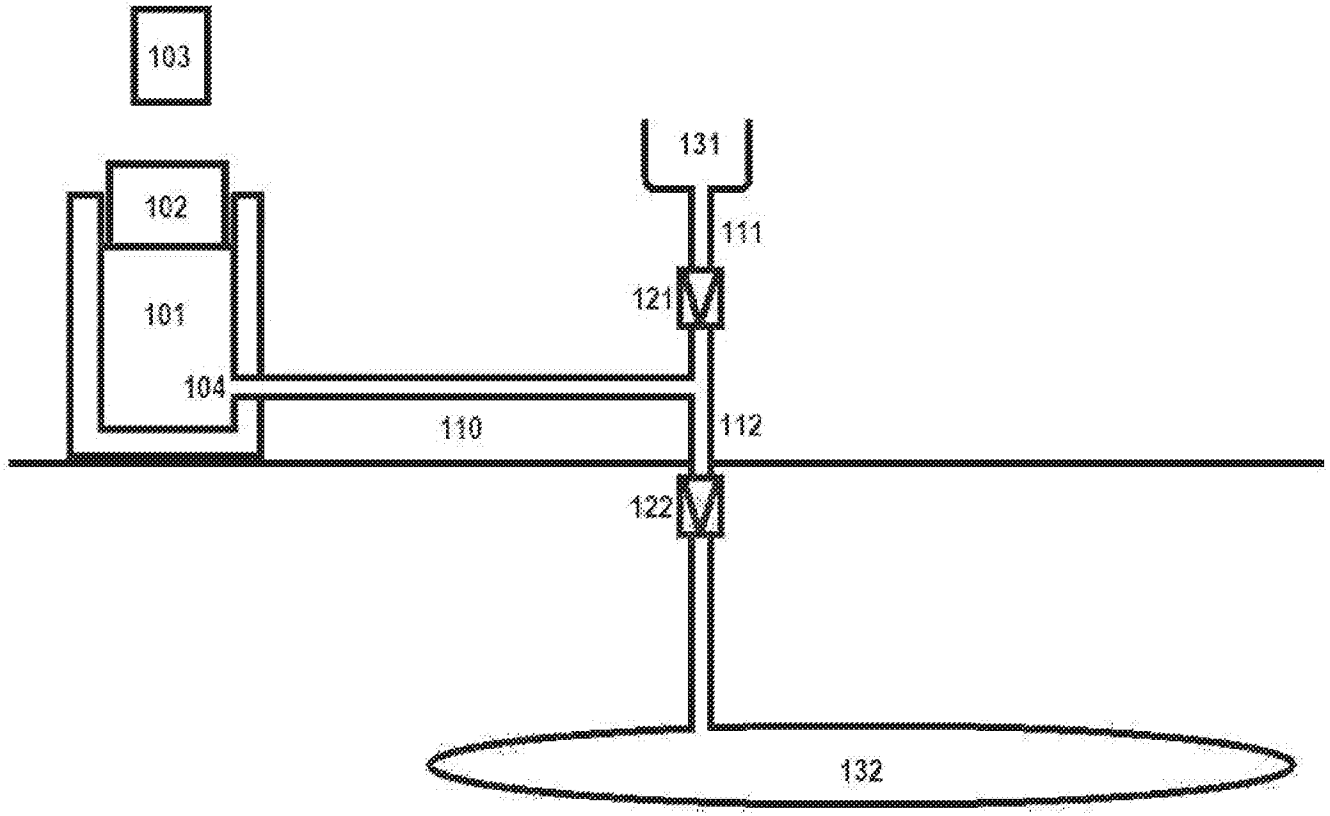
FIG. 1 shows one possible embodiment of the invention in which pressure transients are added to a fluid, which is subsequently injected into subterranean reservoir formation.

FIG. 1 shows a possible embodiment of the invention comprising a system with the following components; a hydraulic cylinder 101 with an opening 104, a piston 102, first and second conduits 111, 112 that are both connected to a third conduit 110, first and second check valves 121,122 arranged in first and second conduits 111,112 respectively, and an object 103 which can collide with piston 102. The fluid from reservoir 131 is placed into the subterranean reservoir formation 132, or the fluid from reservoir 131 is replacing hydrocarbons and/or other fluids in the subterranean reservoir formation 132. The pressure transients that are generated when the object 103 collides with the piston 102 propagate at the sound speed into the subterranean reservoir formation 132 along with the fluid originating from the reservoir 131. These pressure transients enhance the penetration rate in the subterranean reservoir formation 132 and suppress any tendency for blockage and maintain the subterranean reservoir formation 132 in a superior flowing condition. This superior flowing condition increases the rate and the area at which the injected fluid from reservoir 131 can be placed into the subterranean reservoir formation 132. Hydrocarbon recovery operations often involves replacement of hydrocarbons in the subterranean reservoir formation 132 with another fluid which in FIG. 1 comes from reservoir 131, and this exchange of fluids is enhanced by the pressure transients propagating into the subterranean reservoir formation 132.

Figure 2:
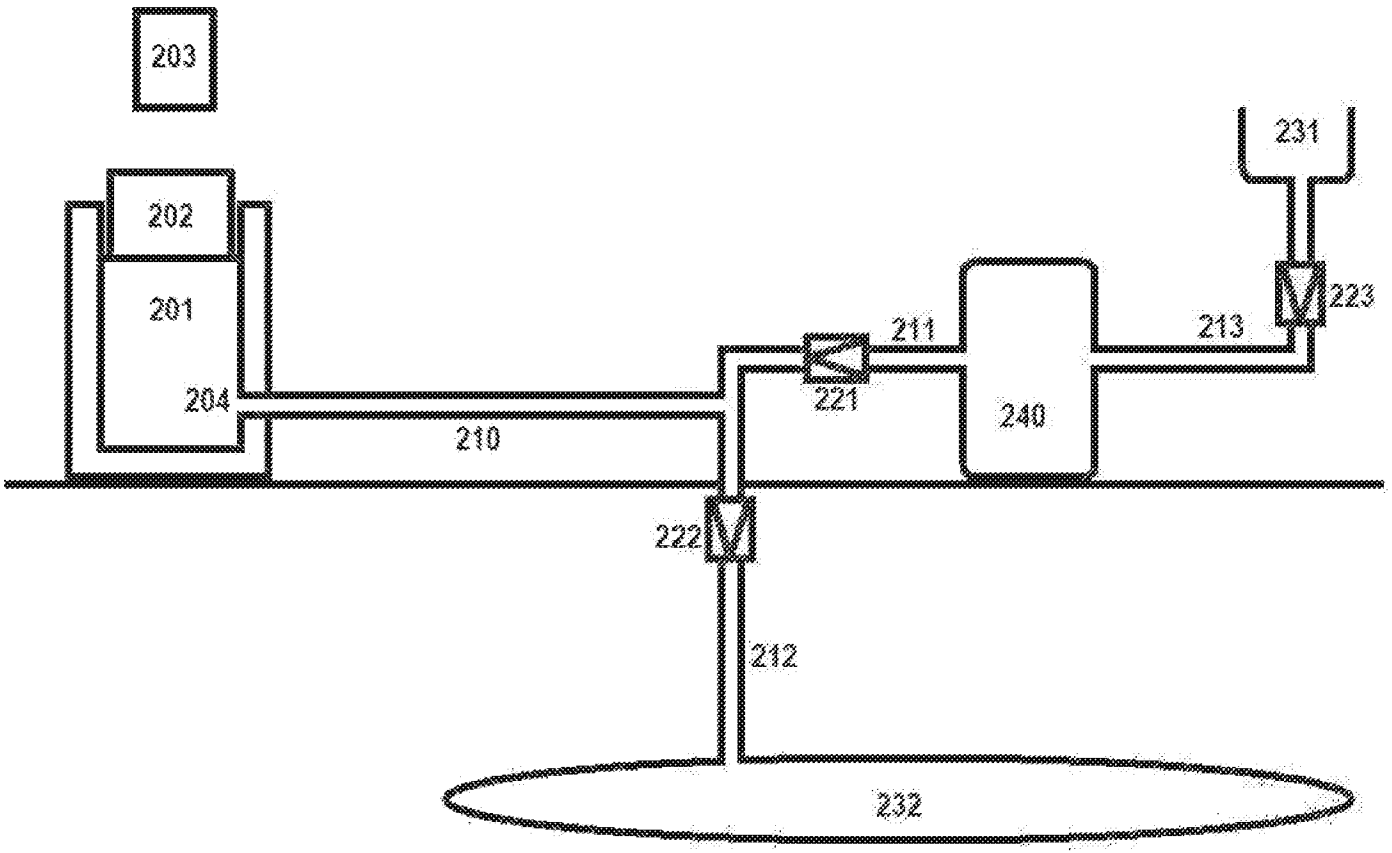
FIG. 2 illustrates another embodiment of the invention in which pressure transients are added to a flowing fluid, which is subsequently injected into subterranean reservoir formation, FIG. 3 outlines another embodiment of the invention in which an accumulator is introduced in the conduit in order to protect fluid transport apparatus against the effect of the pressure transients.

FIG. 2 outlines another embodiment of the invention comprising the same components as the embodiment described in relation to FIG. 1, and additionally comprising a fluid pumping device 240 connected to the conduit system for aiding in the transport of the fluid from the reservoir to the subterranean reservoir formation 232. The system comprises the following components; a hydraulic cylinder 201 with a opening 204, a piston 202, first and second conduits 211, 212 both connected to a third conduit 210, first and second check valves 221,222 arranged in first and second conduits 211,212 respectively, a fluid pumping device 240 connected to the first conduit 211 and a fourth conduit 213, a third check valve 223 arranged in the fourth conduit 213, and an object 203 which can collide with piston 202. The fluid from reservoir 231 is placed into the subterranean reservoir formation 232, or the fluid from reservoir 231 is replacing hydrocarbons and/or other fluids in the subterranean reservoir formation 232. The pressure transients that are generated when the object 203 collides with the piston propagates with the sound speed into the subterranean reservoir formation 232 along with the fluid which is transported by the fluid pumping device 240 from the reservoir 231.

Figure 3:
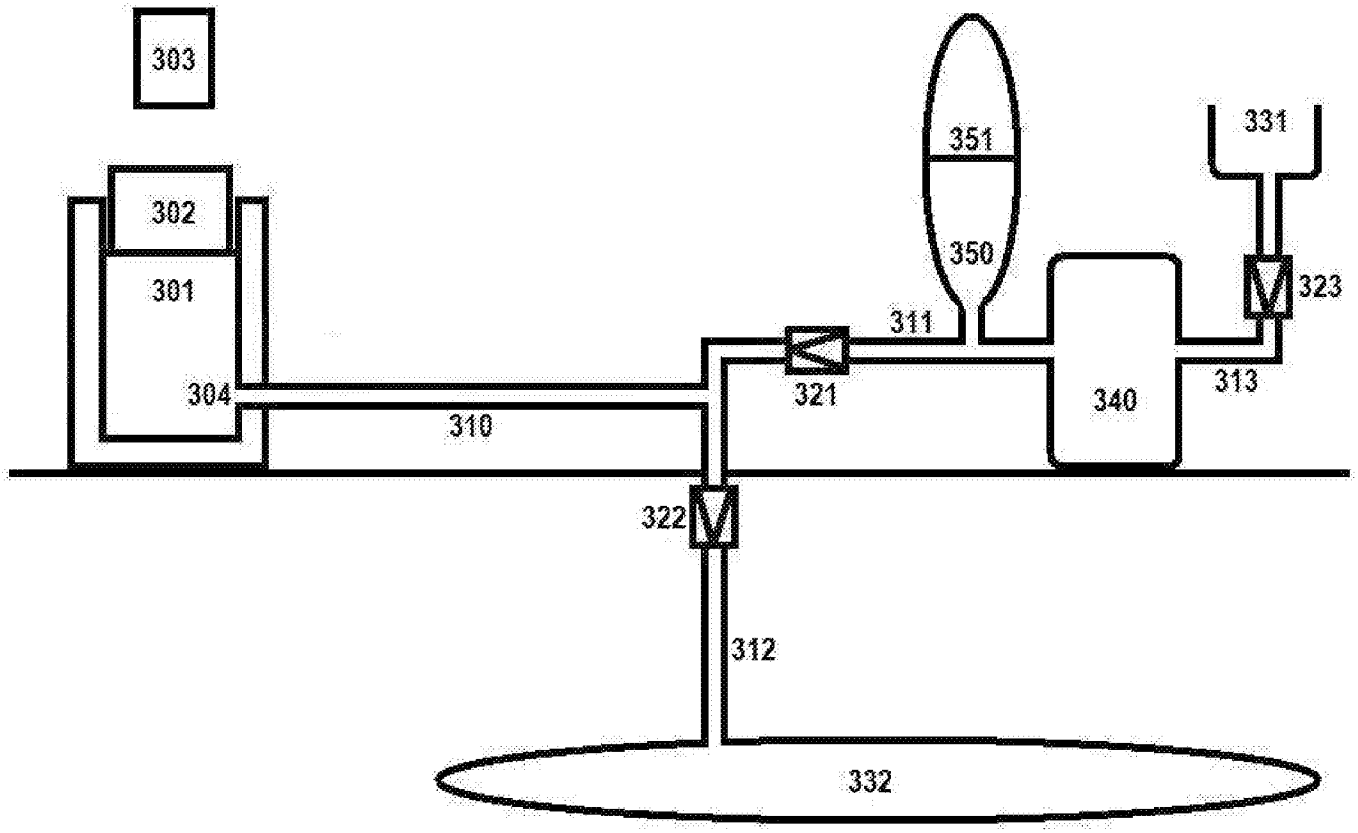

FIG. 3 outlines another embodiment of the inventive methods comprising a system like the systems outlined in relation to FIGS. 1 and 2, additionally comprising an accumulator. The system comprises the following components; a hydraulic cylinder 301 with an opening 304, a piston 302, first and second conduits 311, 312 both connected to a third conduit 310, first and second check valves 321,322 arranged in first and second conduits 311,312 respectively, a fluid pumping device 340 connected to the first conduit 311, a fourth conduit 313, a third check valve 323 arranged in the fourth conduit 313, an accumulator comprising a chamber 350 and a membrane 351 that can separate different fluids in the accumulator which is in fluid communication with the first conduit 311 between the first check valve 321 and the fluid pumping device 340, and an object 303 which can collide with piston 302. The fluid from reservoir 331 is placed into the subterranean reservoir formation 332, or the fluid from reservoir 331 is replacing hydrocarbons and/or other fluids in the subterranean reservoir formation 332. The pressure transients that are generated when the object 303 collides with the piston propagates with the sound speed into the subterranean reservoir formation 332 along with the fluid which is transported by the fluid pumping device 340 from the reservoir 331. The accumulator arranged between the pumping device 340 and the cylinder 301 where the pressure transients are generated acts to dampen out and accumulate any pressure transients travelling through that part of the system of conduits and thereby not aiding in the hydrocarbon recovery operation.

Figure 4:
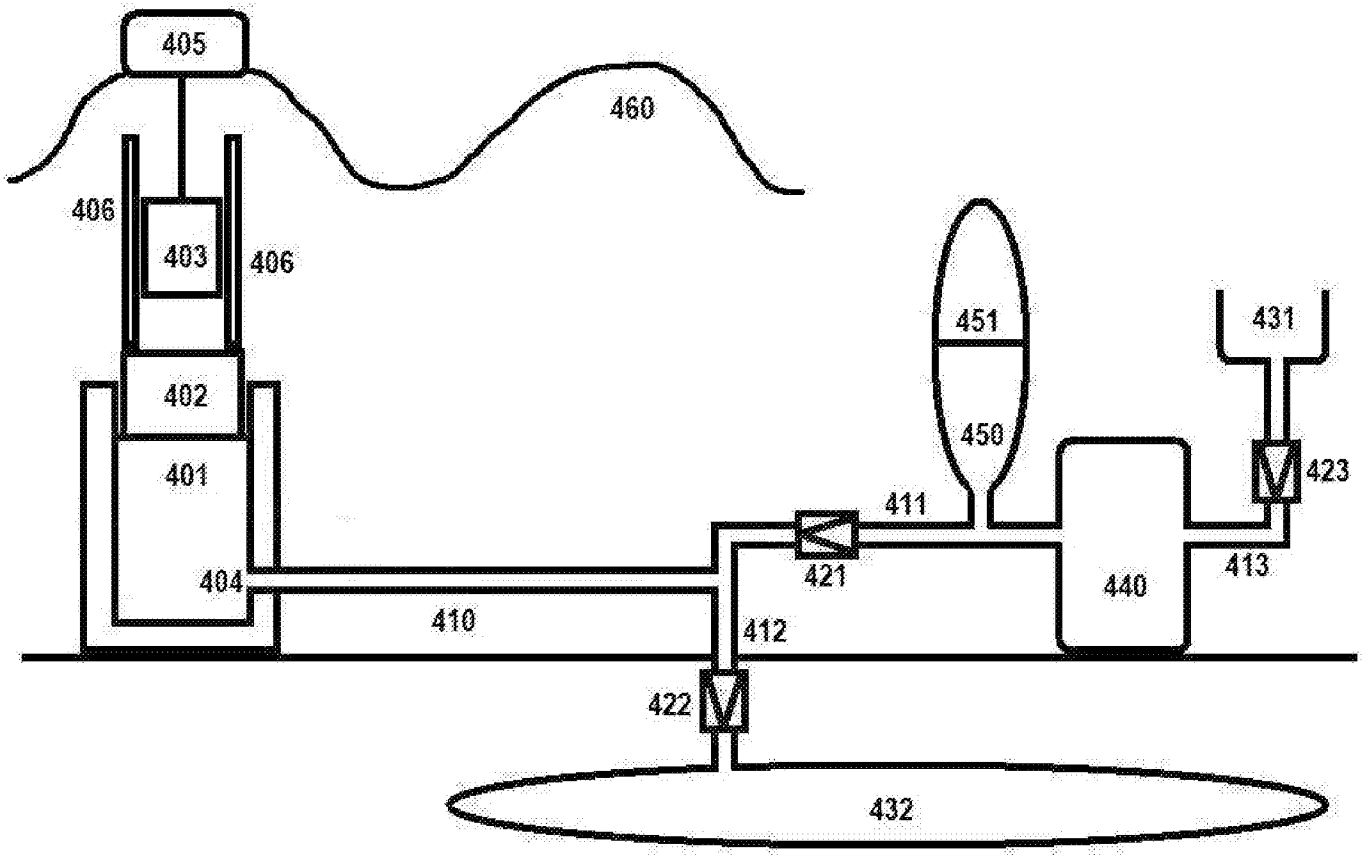
FIG. 4 shows another embodiment of the invention in which the pressure transients are produced by the energy captured from ocean waves, FIG. 5 provides a schematic overview of the configuration applied in experimental testing of our inventive method on Berea sandstone cores.

FIG. 4 outlines another embodiment of the invention comprising a system as described previously in relation to FIGS. 1-3, and where the object 403 caused to collide with the piston 402 is set in motion by ocean waves 460. The system comprises the following components; a hydraulic cylinder 401 with an opening 404, a piston 402, first and second conduits 411, 412 that are both connected to a third conduit 410, first and second check valves 421,422 arranged in first and second conduits 411,412 respectively, a fluid pumping device 440 connected to the first conduit 411, a fourth conduit 413, a third check valve 423 arranged in the fourth conduit 413, an accumulator comprising a chamber 450 and a membrane 451 that can separate different fluids in the accumulator which is in fluid communication with the first conduit 411 between the first check valve 421 and the fluid pumping device 440, a floating buoy 405 connected to a object 403, a guiding installation 406 that prevents the object 403 from drifting horizontally relative to the piston 402, the object 403 being able to collide with piston 402. The system may optionally be configured without any pumping device 440. Likewise, the system may be configured without any accumulator or with further accumulators placed at other locations. The accumulator(s) may likewise be of other types than the one shown here with a membrane. The floating buoy 405 is set in motion by the ocean waves 460, whereas the guiding installation 406 guides the object 403 so that a significant part of the momentum of the object 403 for the collision process with the piston 402 may be provided by the ocean waves 460. The fluid from reservoir 431 is placed into the subterranean reservoir formation 432, or the fluid from reservoir 431 is replacing hydrocarbons and/or other fluids in the subterranean reservoir formation 432. The pressure transients that are generated when the object 403 collides with the piston propagates with the sound speed into the subterranean reservoir formation 432 along with the fluid which is transported by the fluid pumping device 440 from the reservoir 431.

Figure 5:
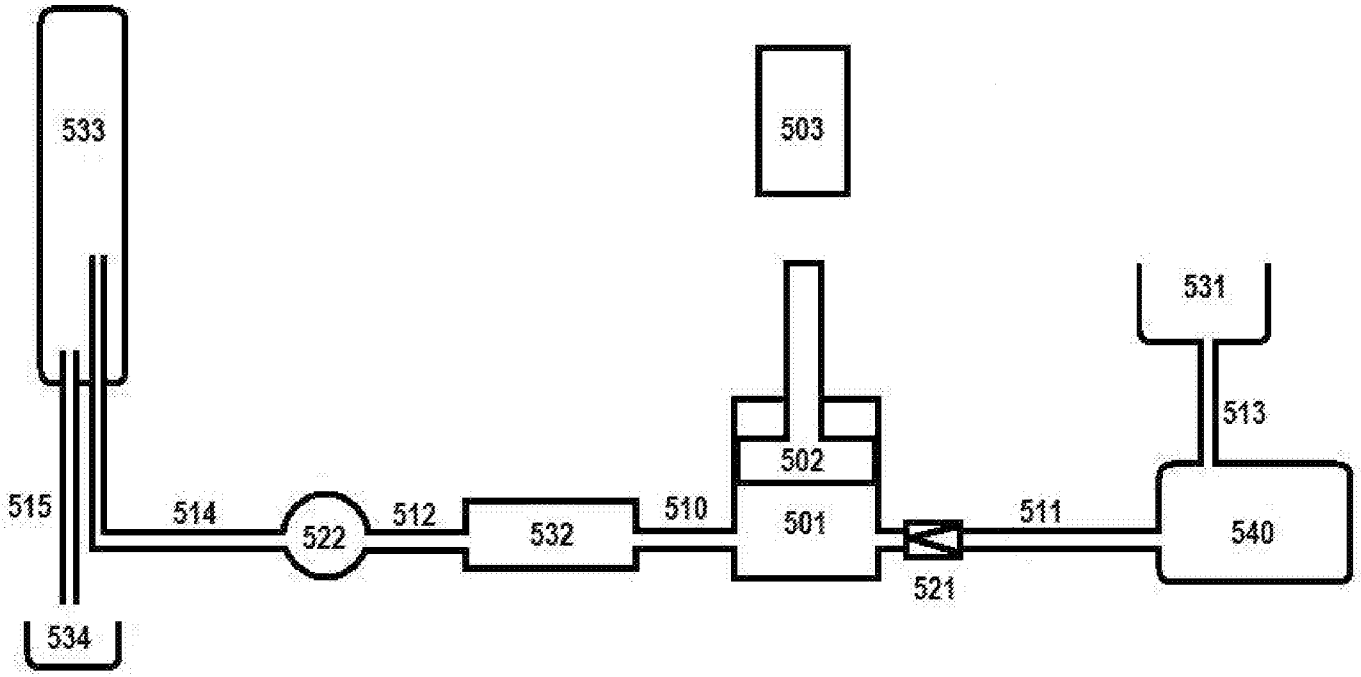

FIG. 5 is an overview of a configuration applied in flooding experiments on Berea sandstone cores, where the following components are employed; a hydraulic cylinder 501 connected to two pipelines 510 and 511, a piston 502, an object 503, a fluid pumping device 540 connected to the pipelines 511 and 513, a reservoir 531 containing the salt water applied in the core flooding experiments, a container 532 where a Berea sandstone core plug is installed and which is connected to the pipelines 510 and 512, a back valve 522 connected to two pipelines 512 and 514, a tube 533 placed essentially vertically and applied for measuring the volume of oil recovered during the core flooding experiments, a pipeline 515 connecting the tube 533 to a reservoir 534 where salt water is collected, and finally a check-valve 521.

During the experiments salt water is pumped from the reservoir 531 through a core material placed in the container 532. In these experiments Berea sandstone cores have been used with different permeabilities of about 100-500 mDarcy, which prior to the experiments were saturated with oil according to standard procedures. The oil recovered from the flooding by the salt water will accumulate at the top of the tube 533 during the experiments, and the volume of the salt water collected in the reservoir 534 is then equal to the volume transported from the reservoir 531 by the pumping device 540. The more specific procedures applied in these experiments follow a standard method on flooding experiments on Berea sandstone cores.

The pipeline 511 is flexible in order to accommodate any small volume of fluid which may be accumulated in the pipeline during the collision process between the piston 502 and the object 503 due to the continuous transporting of fluid by the pumping device 540.

The piston 502 is placed in the cylinder 501 in a bearing and the cylinder space beneath the piston is filled with fluid. In the experiments a hydraulic cylinder for water of about 20 ml is used. The total volume of salt water flowing through the container 532 was seen to correspond closely to the fixed flow rate of the pumping device. Thus, the apparatus comprising the hydraulic cylinder 501, the piston 502 and the object 503 contribute only insignificantly to the transport of salt water in these experiments. The collision of the object with the piston occurs during a very short time interval. Therefore, the fluid is not able to respond to the high impact force by a displacement resulting in a increase of the flow and thus altering of said fixed flow rate. Rather, the fluid is compressed by the impact and the momentum of the piston is converted into a pressure transient. Hence, any motion of the piston 502 during the collision process is believed to relate to a compression of the fluid beneath the piston and not due to any net displacement of fluid out of the hydraulic cylinder 501.

Figure 8:
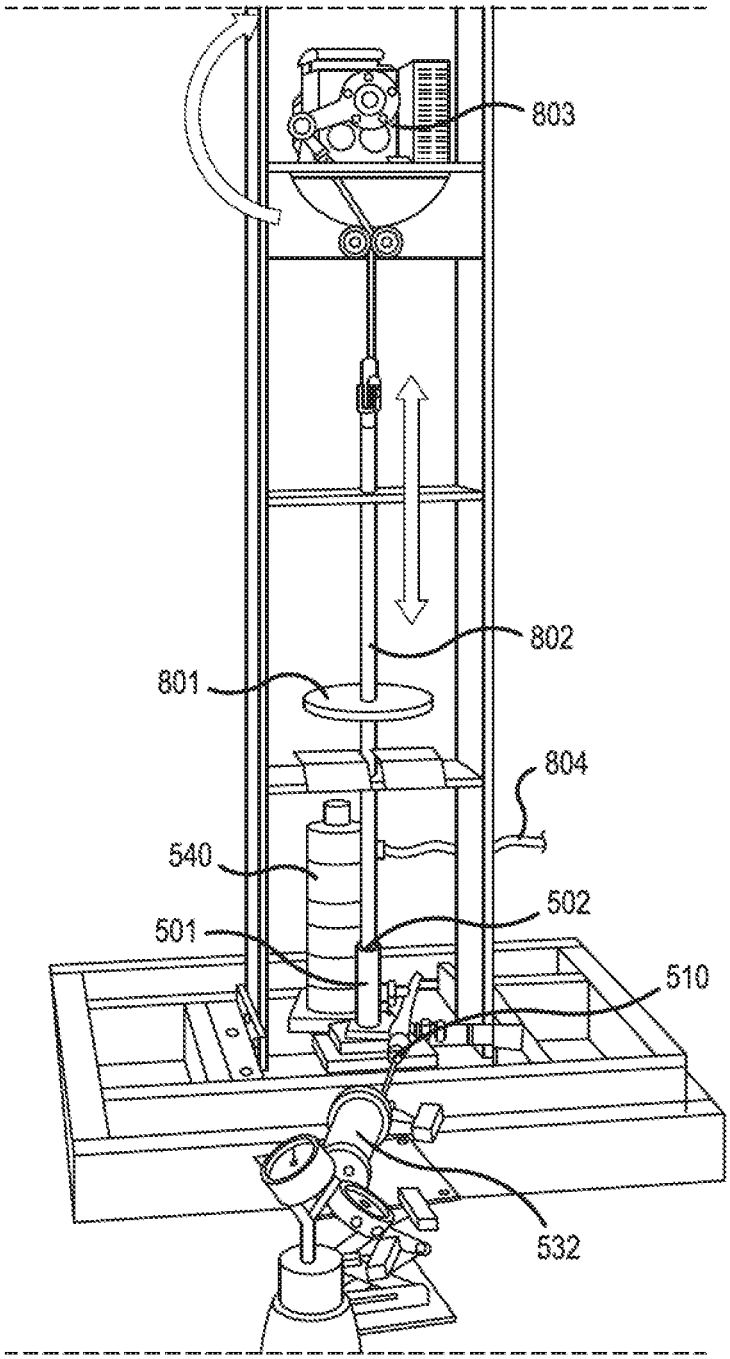
FIG. 8 is a sketch of the experimental set-up for a core flooding experiment on a Berea sandstone core.

The pressure transients during the performed experiments were generated by an object 503 with a weight of 5 kg raised to a height of 17 cm and caused to fall onto the cylinder thereby colliding with the piston 502 at rest. The hydraulic cylinder 501 used had a volume of about 20 ml and an internal diameter of 25 mm corresponding to the diameter of the piston 502. The apparatus for performing the collision process is illustrated in FIG. 8.

Experiments were made with pressure transients generated with an interval of about 6 sec (10 impacts/min) over a time span of many hours.

The movement of the piston 502 caused by the collisions was insignificant compared to the diameter of the piston 502 and the volume of the hydraulic cylinder 501 resulting only in a compression of the total fluid volume which may be deducted from the following. The volume of the hydraulic cylinder 501 is about 20 ml and the fluid volume in the Berea sandstone core in the container is about 20-40 ml (cores with different sizes were applied). The total volume which can be compressed by the object 503 colliding with the piston 502 is therefore about 50-100 ml (including some pipeline volume). A compression of such volume with about 0.5% (demanding a pressure of about 110 Bar since the bulk modulus of water is about 22 000 Bar) represents a reduction in volume of about 0.25-0.50 ml corresponding to a downward displacement of the piston 502 with approximately 1 mm or less. Thus the piston 502 moves about 1 mm over a time interval of about 5 ms during which the pressure transients could have propagated about 5-10 m. This motion is insignificant compared with the diameter of the piston 502 and the volume of the hydraulic cylinder 501.

Figure 6A:
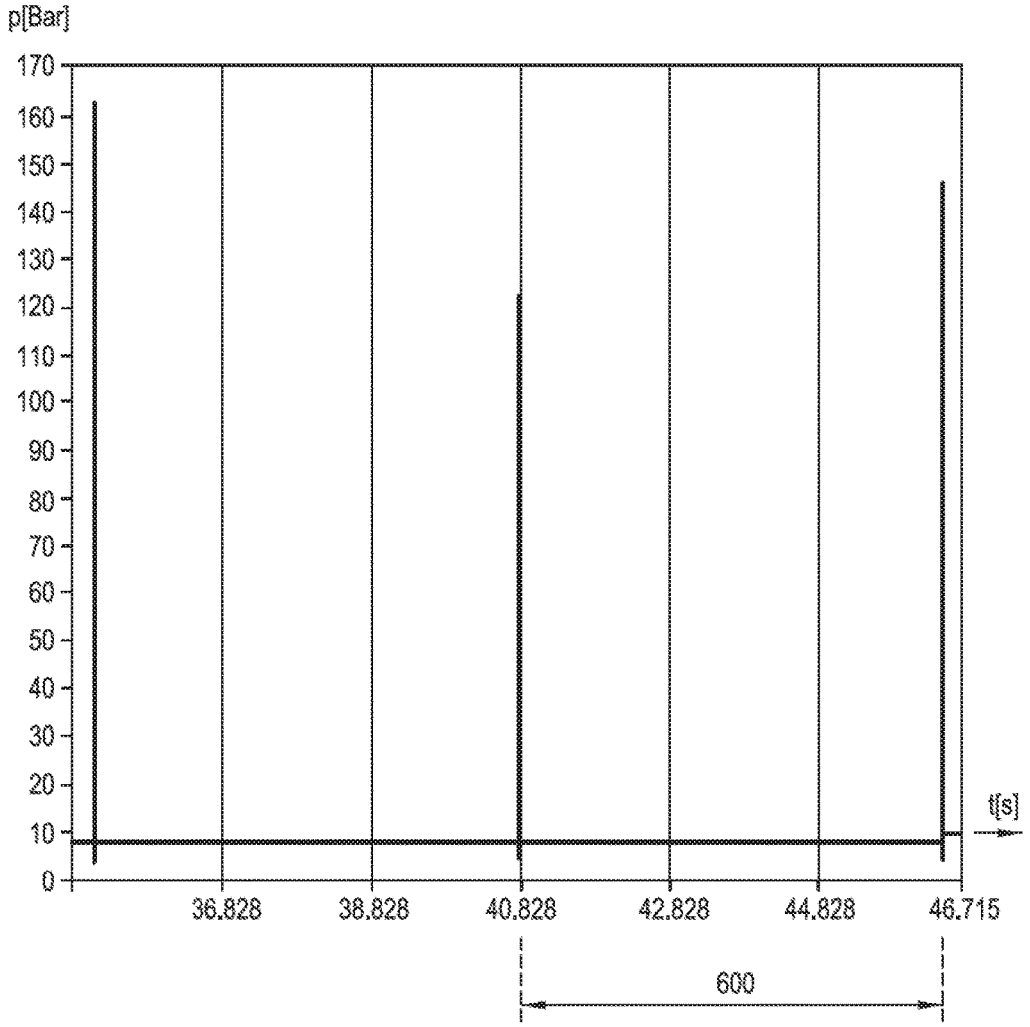
FIG. 6A illustrates the typical shape of a pressure transient obtained during experiments on Berea sandstone cores.

FIG. 6A show the pressure p in the fluid measured at the inlet of the container 532 as a function of time t for a duration of one of the performed experiments. The pressure transients were generated by an object 503 with a weight of 5 kg caused to fall onto the piston from a height of 17 cm. Collisions (and hence pressure transients) were generated at time intervals 600 of approximately 6 s, i.e. a new collision was generated approximately every $6^{th}$ second. By the above mentioned means were generated pressure amplitudes in the range of at least 70-180 Bar or even higher, since the pressure gauges used in the experiments could only measure up to 180 Bar. In comparison, an object with a mass of about 50 kg (with a weight of about 500 N) would be needed in order to push or press (not hammer) down the piston in order to generate a static pressure of only about 10 Bar. The fluid state (turbulence etc.) and the conditions in the Berea Sandstone are never the same for all impacts as the conditions change during the cause of the experiment. The system, therefore, changes after each impact, which may be the reason for the variations between the measured pressure transients.

Figure 6B:
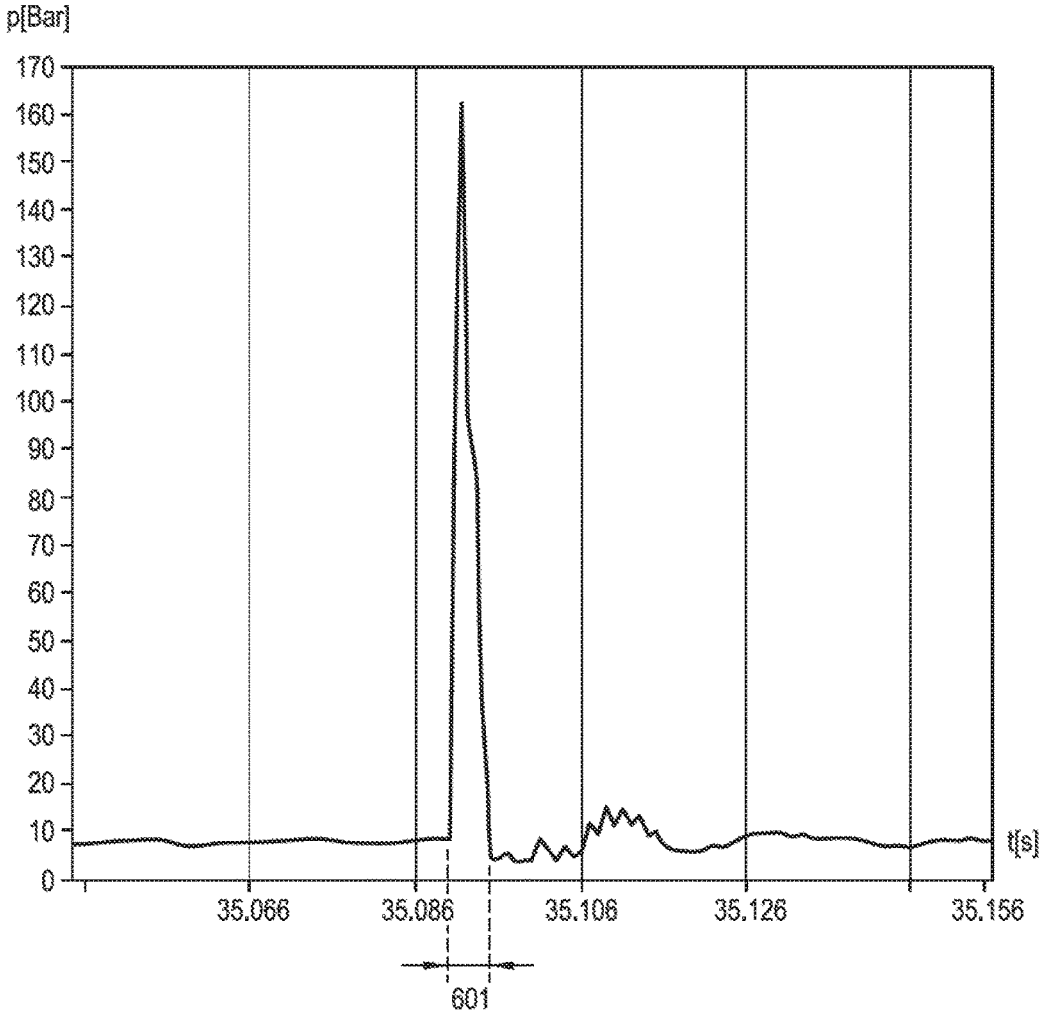
FIG. 6B shows a single pressure transient in greater detail as obtained and measured in the water flooding experiments on a Berea sandstone core.

A single pressure transient is shown in greater detail in FIG. 6B which is also illustrating the typical shape of a pressure transient as obtained and measured in the laboratory water flooding experiments on a Berea sandstone core. Notice the amplitude of about 170 Bar (about 2500 psi), and that the width 601 of each of the pressure transients in these experiments is approximately or about 5 ms, thereby yielding a very steep pressure front and very short raise and fall time. In comparison, pressure amplitudes obtained by pressure pulsing caused by rapid opening of a valve have widths of several seconds and often less than 10 Bar.

FIG. 7 is a summary of some of the results obtained in the water flooding experiments on Berea sandstone cores described previously. Comparative experiments have been conducted for different flooding speeds, and without (noted 'A') and with pressure transients (noted 'B'), and are listed in the table of FIG. 7 below one another.

The experiments performed without pressure transients (noted 'A') were performed with a static pressure driven fluid flow where the pumping device 540 was coupled directly to the core cylinder 532. In other words the hydraulic cylinder 501 including the piston 502 and object 503 was disconnected or bypassed. The same oil type of Decane was used in both series of experiments.

The average (over the cross section of the core plug) flooding speed (in μm/s) is given by the flow rate of the pumping device. In all experiments, except 3B, the apparatus for generating pressure transients contribute insignificantly to the total flow rate and thus the flooding speed, which is desirable since a high flooding speed could result in a more uneven penetration of the injected water, and thus led to an early water breakthrough. In the experiment 3B the experimental set-up further comprised an accumulator placed between the hydraulic cylinder 501 and the fluid pumping device 540, which is believed to have given an additional pumping effect causing the high flooding speed of 30-40 μm/s as reported in the table. As seen from the experimental data, application of pressure transients to the water flooding resulted in a significant increase in the oil recovery rate in the range of approximately 5.3-13.6% (experiments 2 and 4, respectively), thus clearly demonstrating the potential of the proposed hydrocarbon recovery method according to the present invention.

FIG. 8 is a sketch showing the apparatus used for moving the object applied in the collision process in the experiments on Berea sandstone cores, and showing the experimental set-up as applied on the core flooding experiment on a Berea sandstone core as described in the previous.

The pressure transients are here generated by an impact load on the piston 502 in the fluid filled hydraulic cylinder 501. A mass 801 is provided on a vertically placed rod 802 which by means of a motor 803 is raised to a certain height from where it is allowed to fall down onto and impacting the piston 502. The impact force is thus determined by the weight of the falling mass and by the falling height. More mass may be placed on the rod and the impacting load adjusted. The hydraulic cylinder 501 is connected via a tube 511 (not shown in FIG. 8) to a fluid pump 540 which pumps salt water via a tube 804 from a reservoir (not shown) through the cylinder and through an initially oil saturated Berea sandstone core placed in the container 532. Pressure was continuously measured at different positions. A check valve 521 (not shown) between the pump and the cylinder ensures a one-directional flow. When having passed the Berea sandstone core, the fluid (in the beginning the fluid is only oil and after the water break trough it is almost only salt water) is pumped to a tube for collecting the recovered oil and a reservoir for the salt water as outlined in FIG. 5.

The invention claimed is:

1. A method in hydrocarbon recovery operations on a reservoir formation, the method comprising:

transporting a fluid from at least one reservoir to said reservoir formation, by means of at least one fluid transporting apparatus, controlling a flow rate of the fluid into the reservoir formation by the fluid transporting apparatus, arranging an at least partly fluid-filled and partly enclosed space in fluid communication with the reservoir and the reservoir formation, arranging a body in the partly enclosed space such that a first surface portion of the body is in contact with said fluid and a second surface portion of the body is free of contact with said fluid, the body hereby being positioned so as to separate the fluid filled part of said space from a part of said at least one partly enclosed space without fluid, arranging at least one object outside the fluid filled part of said space and outside said fluid, inducing pressure transients in said fluid such as to propagate in said fluid, where said pressure transients are induced by a collision process generated by the object falling onto and colliding outside said fluid with said second surface portion of the body such that the collision occurs outside said fluid filled part of said space, and wherein the collision process is such that the body remains in the same position whereby the collision process does not change the flow rate.

2. The method in hydrocarbon recovery operations according to claim 1, where said at least one fluid is provided from at least one reservoir in fluid communication with said partly enclosed space.

3. The method in hydrocarbon recovery operations according to claim 2, further comprising the step of transporting said at least one fluid from said at least one reservoir, by means of at least one fluid transporting apparatus.

4. The method in hydrocarbon recovery operations according to claim 1, where said collision process comprises the object being caused to fall onto said body by means of the gravity force.

5. The method in hydrocarbon recovery operations according to claim 1, where said object collides with said body in a second fluid different from the first fluid.

6. The method in hydrocarbon recovery operations according to claim 5, wherein said second fluid is air.

7. The method in hydrocarbon recovery operations according to claim 1, further comprising generating a number of said collision processes at time intervals.

8. The method in hydrocarbon recovery operations according to claim 7, where said collision processes are generated at time intervals in the range of 2-20 sec.

9. The method in hydrocarbon recovery operations according to claim 7, comprising the step of generating a first sequence of collision processes with a first setting of pressure amplitude and time between the collisions, followed by a second sequence of collision processes with a different setting of pressure amplitude and time between the collisions.

10. The method in hydrocarbon recovery operations according to claim 9, where said setting of pressure amplitude is changed by changing the mass of said moving object, or changing the velocity of said moving object relative to the velocity of said body.

11. The method in hydrocarbon recovery operations according to claim 1, where said body is positioned such as to separate said fluid from a part of said at least partly enclosed space without fluid.

12. The method in hydrocarbon recovery operations according to claim 1, where said partly enclosed space comprises a first and a second part separated by said body and where the method further comprises filling the first part with fluid prior to said collision process.

13. The method in hydrocarbon recovery operations according to claim 1, where said at least one moving object is connected to at least one wave motion capturing system.

14. The method in hydrocarbon recovery operations according to claim 13, wherein said at least one wave motion capturing system comprises at least one floating buoy arranged such as to be set in motion by waves, and where the motion of said at least one floating buoy induces movement of said object, thereby obtaining a nonzero momentum of said object prior to the collision with said body.

15. The method in hydrocarbon recovery operations according to claim 7, where said collision processes are generated at time intervals in the range of 4-10 sec.

* * * * *